United States Patent [19]

Hartman

[11] 4,005,027

[45] * Jan. 25, 1977

[54] SCOURING COMPOSITIONS

[75] Inventor: William L. Hartman, Cheviot, Ohio

[73] Assignee: The Procter & Gamble Company, Cincinnati, Ohio

[ * ] Notice: The portion of the term of this patent subsequent to Oct. 12, 1993, has been disclaimed.

[22] Filed: Nov. 12, 1973

[21] Appl. No.: 415,033

Related U.S. Application Data

[63] Continuation-in-part of Ser. No. 377,976, July 10, 1973, abandoned.

[52] U.S. Cl. ..... 252/95; 252/99; 252/103; 252/140; 252/155; 252/173; 252/317; 252/DIG. 14

[51] Int. Cl.[2] ..... C11D 3/395

[58] Field of Search ..... 252/99, 102, 103, 546, 252/550, DIG. 14, 317, 140, 155, 173, 531

[56] References Cited

UNITED STATES PATENTS

| | | | |
|---|---|---|---|
| 3,042,622 | 7/1962 | Kirschenauer | 252/99 |
| 3,558,496 | 1/1971 | Zmoda | 252/99 |
| 3,630,922 | 12/1971 | McClain et al. | 252/156 X |
| 3,684,722 | 8/1972 | Hynam et al. | 252/98 |
| 3,702,826 | 11/1972 | Koceich et al. | 252/99 |
| 3,715,314 | 2/1973 | Morgenstern | 252/99 |

*Primary Examiner*—Thomas J. Herbert, Jr.
*Assistant Examiner*—Bruce H. Hess
*Attorney, Agent, or Firm*—George W. Allen; Ronald L. Hemingway; Richard C. Witte

[57] ABSTRACT

Stable, fluid, hard-surface scouring cleansers containing bleach, clay, abrasive, surfactant, buffer and water. Such compositions combine the stain and soil removal properties of a strong active chlorine bleaching agent and bleach-stable surfactant in a false body abrasive cleanser having desirable chemical and physical stability.

17 Claims, No Drawings

SCOURING COMPOSITIONS

CROSS REFERENCE TO RELATED APPLICATION

This application is a continuation-in-part of the application of William L. Hartman having Ser. No. 377,976, filed July 10, 1973, now abandoned.

BACKGROUND OF THE INVENTION

The instant invention relates to liquid or semi-liquid, i.e. fluid, bleach-containing, abrasive scouring cleansers. Solutions of liquid hypochlorite and surfactant are thickened by means of a colloid-forming clay material to form a false body composition capable of suspending conventional scouring abrasives. Physical and chemical stability of such formulations is realized by employing a buffering agent capable of maintaining the false body compositions at a pH of from about 10.5 to 14.

There has been an increasing demand for bleach-containing liquid detergent compositions adapted for cleaning hard surfaces. To obtain optimum cleaning and consumer acceptance, such compositions must be homogeneous and easily pourable. These compositions, when intended for the retail consumer market, should maintain their homogeneity and bleaching effectiveness during ordinary periods of storage and use.

An extremely difficult problem in providing hard surface bleaching detergent compositions of this type is maintaining insoluble abrasive particulate material uniformly dispersed throughout while at the same time formulating compositions which contain bleaching and surfactant materials that are normally highly chemically active. The chemically active materials of such compositions tend to degrade and render ineffective those other composition materials which are designed to maintain abrasive suspension or provide more desirable composition physical properties. Some agents designed to aid in abrasive suspension also tend to deposit on the hard surfaces being cleaned, thereby leaving an unsightly film or haze.

Another problem involving liquid or semi-liquid compositions containing strong bleaching agents and surfactants relates to the chemical stability of such products. In addition to rendering some suspending agents ineffective, chemical interaction of bleach and surfactant materials with such other ingredients as well as with each other can result in the degradation and loss of effectiveness of the bleaching agents and surfactants themselves.

Finally, liquid scouring compositions are inherently difficult to utilize effectively on hard surfaces positioned in such a way that free-flowing liquids quickly run along such surfaces, thereby minimizing cleanser-surface contact time. This is especially noticeable when vertical surfaces such as walls are to be cleaned.

Some liquid, bleach-containing abrasive hard surface cleaning compositions are known to the prior art. For example, U.S. Pat. No. 3,630,922 describes liquid, abrasive-containing, bleach-containing detergent compositions capable of suspending particulate abrasive material homogeneously throughout the composition. Such a composition, however, requires the presence of particular types of surfactants and electrolytes and is generally of such low viscosity that relatively large amounts of this material are required to insure that enough scouring composition remains in contact with hard surfaces during a scouring operation. U.S. Pat. No. 3,558,496 describes a thickened bleach composition capable of remaining in contact with hard surfaces for extended periods of time. Such a composition, however, contains no surfactant or abrasive material and further requires a rather particular mixture of positively and negatively charged clay thickening agents in order to realize acceptable thickened bleach products.

Thus, there is a continuing need for hard surface scouring products which are chemically and physically stable, which are capable of remaining in contact for extended periods of time with the hard surfaces to be cleaned and which are highly effective in removing soil and stain from such hard surfaces by virtue of the presence of highly chemically active bleaching and surface active agents as well as insoluble abrasive materials.

Accordingly, it is an object of the present invention to provide bleach-containing, surfactant-containing abrasive hard surface scouring compositions which are physically stable, i.e., compositions which are capable of maintaining abrasive particulate material uniformly suspended throughout and which do not excessively separate into discrete physical phases.

It is a further object of the present invention to provide such scouring compositions which are chemically stable over extended periods of time in spite of the presence of materials which are normally highly chemically reactive.

It is a further object of the present invention to provide such scouring compositions which are capable of remaining in contact with hard surfaces for an extended period of time.

It is a further object of the present invention to provide such scouring compositions which are highly effective in removing stain and soil from hard surfaces without themselves depositing an unsightly film or haze onto such surfaces.

It has been surprisingly discovered that by combining particular hypochlorite-yielding bleaching agents, particular bleach-stable surfactants, and certain buffering agents in an aqueous solution thickened with a certain type of colloid-forming clay and abrasive material, stable false body compositions can be obtained which accomplish the above objectives and which are surprisingly superior to hard surface scouring compositions of the prior art.

SUMMARY OF THE INVENTION

The instant false body, hard surface scouring cleanser compositions comprise from about 0.2% to about 5% by weight of a bleaching agent; from about 1% to about 6% by weight of a colloid-forming clay; from about 0.1% to about 3% by weight of a bleach-stable surfactant; from about 5% to about 60% by weight of abrasive; from about 1% to about 15% by weight of a buffering agent and from about 10% to about 80% by weight of water.

The bleaching agent can be any active chlorine bleaching compound which yields a hypochlorite species in aqueous solution. The colloid-forming clay material can be of the smectite or attapulgite type or mixtures thereof and forms a false body sol or gel when admixed with water in the concentrations of the instant invention.

The bleach-stable surfactant can either be a water-soluble alkyl sulfate salt containing from about 8 to 18 carbon atoms in the alkyl group or a water-soluble betaine surfactant of the general formula

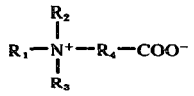

wherein $R_1$ is an alkyl group containing 8 to 18 carbon atoms; $R_2$ and $R_3$ are lower alkyl groups containing from about 1 to 4 carbon atoms and $R_4$ is an alkylene group which can be methylene, propylene, butylene or pentylene.

The abrasive material can be any insoluble particulate matter having an average particle diameter ranging from about 1 to 250 microns and a specific gravity of from about 0.5 to about 5. The inorganic buffering agent must be capable of maintaining composition pH within the range of from about 10.5 to 14.

DETAILED DESCRIPTION OF THE INVENTION

The aqueous false body scouring cleanser compositions of the instant invention contain six essential components, i.e., a chlorine bleaching agent, a colloid-forming clay, a bleach-stable surfactant, abrasive, buffering agent and water. Each of these essential composition components as well as optional materials and composition preparation are discussed in detail as follows:

BLEACHING AGENT

From about 0.2% to about 5% by weight, preferably from about 0.5% to 2.0% by weight, of the instant compositions comprises a bleaching agent of the type which yields a hypochlorite species in aqueous solution. The hypochlorite ion is chemically represented by the formula $OCl^-$. The hypochlorite ion is a strong oxidizing agent and for this reason materials which yield this species are considered to be powerful bleaching agents.

The strength of an aqueous solution containing hypochlorite ion is measured in terms of available chlorine. This is the oxidizing power of the solution measured by the ability of the solution to liberate iodine from an acidified iodide solution. One hypochlorite ion has the oxidizing power of 2 atoms of chlorine, i.e. one molecule of chlorine gas.

At lower pH levels, aqueous solutions formed by dissolving hypochlorite-yielding compounds contain active chlorine partially in the form of hypochlorous acid moieties and partially in the form of hypochlorite ions. At pH levels above about 10, i.e., at pH levels of the instant compositions, essentially all of the active chlorine is in the form of hypochlorite ion.

Those bleaching agents which yield a hypochlorite species in aqueous solution include alkali metal and alkaline earth metal hypochlorites, hypochlorite addition products, chloramines, chlorimines, chloramides, and chlorimides. Specific examples of compounds of this type include sodium hypochlorite, potassium hypochlorite, monobasic calcium hypochlorite, dibasic magnesium hypochlorite, chlorinated trisodium phosphate dodecahydrate, potassium dichloroisocyanurate, sodium dichloroisocyanurate, 1,3-dichloro-5,5-dimethylhydantoin, N-chlorosulfamide, Chloramine T, Dichloramine T, Chloramine B and Dichloramine B. A preferred bleaching agent for use in the compositions of the instant invention is sodium hypochlorite.

Most of the above described hypochlorite-yielding bleaching agents are available in solid or concentrated form and are dissolved in water during synthesis of the compositions of the instant invention. Some of the above materials are available as aqueous solutions.

COLLOID-FORMING CLAY

From about 1% to about 6% by weight, preferably from about 1.5% to 4.0% by weight, of the instant compositions comprises an inorganic, colloid-forming clay selected from the group consisting of smectites, attapulgites and mixtures of smectites and attapulgites. Such clays are added to the instant compositions for two reasons.

First, these materials, when admixed with water and the other components of the instant invention, form compositions having false body properties. "False body" fluids are related to but are not identical to fluids having thixotropic properties. True thixotropic materials break down completely under the influence of high stresses and behave like true liquids even after the stress has been removed. False-bodied materials, on the other hand, do not, after stress removal, lose their solid properties entirely and can still exhibit a yield value even though it might be diminished. The original yield value is regained only after such fluids are at rest for considerable lengths of time.

The instant false-body mixtures in a quiescent state are highly viscous, are Bingham plastic in nature, and have relatively high yield values. When subjected to shear stresses, however, such as being shaken in a bottle or squeezed through an orifice, the instant compositions fluidize and can be easily dispensed. When the shear stress is stopped, the instant clay containing compositions quickly revert to their high viscosity/Bingham plastic state.

Secondly, the clay component of the instant compositions serves as a suspending agent for the insoluble particulate abrasive material which is also essentially present.

The clay materials which function in the instant composition as thickening and suspending agents can be described as expandable layered clays, i.e., aluminosilicates and magnesium silicates. The term "expandable" as used to describe the instant clays relates to the ability of the layered clay structure to be swollen, or expanded, on contact with water. The expandable clays used herein are those materials classified geologically as smectites (or montmorillonoids) and attapulgites (or palygorskites).

Smectites are three-layered clays. There are two distinct classes of smectite-type clays. In the first, aluminum oxide is present in the silicate crystal lattice; in the second class of smectites, magnesium oxide is present in the silicate crystal lattice. The general formulas of these smectites are $Al_2(Si_2O_5)_2(OH)_2$ and $Mg_3(Si_2O_5)(OH)_2$, for the aluminum and magnesium oxide type clays, respectively. It is to be recognized that the range of the water of hydration in the above formulas can vary with the processing to which the clay has been subjected. This is immaterial to the use of the smectite clays in the present compositions in that the expandable characteristics of the hydrated clays are dictated by the silicate lattice structure. Furthermore, atom substitution by iron and magnesium can occur within the crystal lattice of the smectites, while metal cations such as $Na^+$, $Ca^{++}$, as well as $H^+$, can be copresent in the water of hydration to provide electrical neutrality. Although the presence of iron in such clay material is preferably avoided to minimize chemical interaction between clay and bleach, such cation substitutions in general are immaterial to the use of the clays herein since the desirable physical properties of the clay are not substantially altered thereby.

The layered expandable aluminosilicate smectite clays useful herein are further characterized by a dioctahedral crystal lattice, whereas the expandable magnesium silicate smectite clays have a trioctahedral crystal lattice.

The smectite clays used in the compositions herein are all commercially available. Such clays include, for example, montomorillonite (bentonite) volchonskoite, nontronite, beidellite, hectorite, saponite, sauconite and vermiculite. The clays herein are available under commercial names such as "Fooler Clay" (clay found in a relatively thin vein above the main bentonite or montmorillonite veins in the Black Hills) and various trade names such as Thixogel No. 1 and Gelwhite GP from Georgia Kaolin Company, Elizabeth, New Jersey (both montmorillonites); Volclay BC and Volclay No. 325, from American Colloid Company, Skokie, Illinois; Black Hills Bentonite BH 450, from International Minerals and Chemicals; Veegum Pro and Veegum F, from R. T. Vanderbilt (both hectorites); Barasym NAS-100, Barasym NAH-100, Barasym SMM 200, and Barasym LIH-200, all synthetic hectorites and saponites marketed by Baroid Division, NL, Industries, Inc.

Smectite clays are preferred for use in the instant invention. Montmorillonite, hectorite and saponite are the preferred smectites. Gelwhite GP, Barasym NAS-100 and Barasym NAH-100 are the preferred montmorillonites, hectorites and saponites.

A second type of expandable clay material useful in the instant invention is classified geologically as attapulgite (palygorskite). Attapulgites are magnesium-rich clays having principles of superposition of tetrahedral and octahedral unit cell elements different from the smectites. An idealized composition of the attapulgite unit cell is given as: $(OH_2)_4(OH)_2Mg_5Si_8O_{20}\cdot 4H_2O$.

A typical attapulgite analyses yields 55.02% $SiO_2$; 10.24% $Al_2O_3$; 3.53% $Fe_2O_3$; 10.49% MgO; 0.47% $K_2O$; 9.73% $H_2O$ removed at 150° C; 10.13% $H_2O$ removed at higher temperatures.

Like the smectites, attapulgite clays are commercially available. For example, such clays are marketed under the tradename Attagel, i.e. Attagel 40, Attagel 50 and Attagel 150 from Engelhard Minerals & Chemicals Corporation.

Particularly preferred for the colloid-forming clay component in certain embodiments of the instant composition are mixtures of smectite and attapulgite clays. with higher abrasive levels, i.e. above about 20% by weight, such a clay mixture provides compositions which have false body properties surprisingly more desirable than compositions prepared with either smectite or attapulgite alone. In general, such mixed clay compositions exhibit increased and prolonged fluidity upon application of shear stress but are still adequately thickened solutions at times when flow is not desired. Clay mixtures in a smectite/attapulgite weight ratio of from 5:1 to 1:5 are preferred. Ratios of from 2:1 to 1:2 are more preferred. A ratio of about 1:1 is most preferred.

As noted above, the clays employed in the compositions of the present invention contain cationic counter ions such as protons, sodium ions, potassium ions, calcium ions, magnesium ions and the like. It is customary to distinguish between clays on the basis of one cation which is predominately or exclusively absorbed. For example, a sodium clay is one in which the absorbed cation is predominately sodium. Such absorbed cations can become involved in exchange reactions with cations present in aqueous solutions.

Clay materials obtained under the forgoing commercial tradenames can comprise mixtures of the various discrete mineral entities. Such mixtures of the minerals are suitable for use in the present compositions. In addition, natural clays sometimes consist of particles in which unit layers of different types of clay minerals are stacked together (interstratification). Such clays are called mixed layer clays, and these materials are also suitable for use herein.

The colloid-forming clay materials useful in the instant invention are described more fully in H. van Olphen, "Clay Minerology", *An Introduction to Clay Colloid Chemistry*, Interscience Publishers, 1963; pp 54–73 and Ross and Hendricks, "Minerals of the Montmorillonite Group" *Professional Paper 205B of the United States Department of the Interior Geological Survey*, 1945; pp 23–79; both articles being incorporated herein by reference.

By selecting one or more of the particular types of clay or clay mixtures described above for use in the instant compositions in combination with the other essential components, compositions which are both physically and chemically stable can be realized without utilization of organic suspending agents or specially selected mixtures of clays of different electrical charges. Such clays also deposit surprisingly little noticeable film or haze on hard surfaces when compositions containing these clays are used to clean such surfaces.

BLEACH-STABLE SURFACTANT

From about 0.1% to about 3% by weight, preferably from about 0.25% to 1% by weight, of the instant compositions comprises a bleach-stable surfactant compound. Such surfactants are necessary within scouring cleansers such as those of the instant invention in order to render such compositions effective for removal of soil and stains from hard surfaces.

The surfactant selected for use in the present compositions must be stable against chemical decomposition and oxidation by the strong active chlorine bleaching agent also essentially present. Accordingly, surfactant materials of the instant invention must contain no functionalities (such as ether linkages, unsaturation, some aromatic structures, or hydroxyl groups) which are susceptible to oxidation by the hypochlorite species found in the present compositions. Thus many of the commonly employed surfactant materials of the prior art, i.e., alkyl benzene sulfonates, olefin sulfonates, alkyl glyceryl ether sulfonates, alkyl ether sulfates and ethoxylated nonionic surfactants are to be avoided in the compositions of the instant invention.

Bleach-stable surfactants which are especially resistant to hypochlorite oxidation fall into two main groups. One such class of bleach-stable surfactants are the water-soluble alkyl sulfates containing from about 8 to 18 carbon atoms in the alkyl group. Alkyl sulfates are the water-soluble salts of sulfated fatty alcohols. They are produced from natural or synthetic fatty alcohols containing from about 8 to 18 carbon atoms. Natural fatty alcohols include those produced by reducing the glycerides of naturally occurring fats and oils. Fatty alcohols can also be produced synthetically, for example, by the Oxo process. Examples of suitable alcohols which can be employed in alkyl sulfate manufacture include decyl, lauryl, myristyl, palmityl and stearyl alcohols and the mixtures of fatty alcohols derived by reducing the glycerides of tallow and coconut oil.

Specific examples of alkyl sulfate salts which can be employed in the instant detergent compositions include sodium lauryl alkyl sulfate, sodium stearyl alkyl sulfate sodium palmityl alkyl sulfate, sodium decyl sulfate, sodium myristyl alkyl sulfate, potassium lauryl alkyl sulfate, potassium stearyl alkyl sulfate, potassium decyl sulfate, potassium palmityl alkyl sulfate, potassium myristyl alkyl sulfate, sodium dodecyl sulfate, potassium dodecyl sulfate, potassium tallow alkyl sulfate, sodium tallow alkyl sulfate, sodium coconut alkyl sulfate, potassium coconut alkyl sulfate and mixtures of these surfactants. Highly preferred alkyl sulfates are sodium coconut alkyl sulfate, potassium coconut alkyl sulfate, potassium lauryl alkyl sulfate and sodium lauryl alkyl sulfate.

A second class of bleach-stable surfactant materials operable in the instant invention are the water-soluble betaine surfactants. These materials have the general formula:

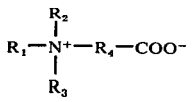

wherein $R_1$ is an alkyl group containing from about 8 to 18 carbon atoms; $R_2$ and $R_3$ are each lower alkyl groups containing from about 1 to 4 carbon atoms, and $R_4$ is an alkylene group selected from the group consisting of methylene, propylene, butylene and pentylene. (Propionate betaines decompose in aqueous solution and are hence not included in the instant compositions.)

Examples of suitable betaine compounds of this type include dodecyldimethylammonium acetate, tetradecyldimethylammonium acetate, hexadecyldimethylammonium acetate, alkyldimethylammonium acetate wherein the alkyl group averages about 14.8 carbon atoms in length, dodecyldimethylammonium butanoate, tetradecyldimethylammonium butanoate, hexadecyldimethylammonium butanoate, dodecyldimethylammonium hexanoate, hexadecyldimethylammonium hexanoate, tetradecyldiethylammonium pentanoate and tetradecyldipropyl ammonium pentanoate. Especially preferred betaine surfactants include dodecyldimethylammonium acetate, dodecyldimethylammonium hexanoate, hexadecyldimethylammonium acetate, and hexadecyldimethylammonium hexanoate.

ABRASIVE MATERIAL

From about 5% to about 60% by weight, preferably from about 8% to 32% by weight, of the instant compositions comprise an insoluble particulate abrasive material. Such insoluble materials have particle size diameters ranging from about 1 to about 250 microns and specific gravities of from about 0.5 to about 5.0. It is preferred that the diameter of the particles range from about 2 microns to about 60 microns and that their specific gravity range from about 1.0 to about 2.8. Insoluble abrasive particulate material of this size and specific gravity can easily be suspended in the false body scouring compositions of the instant invention in their quiescent state.

The abrasives which can be utilized include, but are not limited to, quartz, pumice, pumicite, titanium dioxide ($TiO_2$), silica sand, calcium carbonate, zirconium silicate, diatomaceous earth, whiting and feldspar. Silica sand is the preferred abrasive for use in the instant compositions.

BUFFERING AGENT

From about 1% to about 15% by weight, preferably from about 2% to 5% by weight, of the present compositions comprises an inorganic buffering agent capable of maintaining composition pH within the range of from about 10.5 to 14; preferably from about 11 to 13. Maintenance of composition pH within this relatively high range is essential to the preservation of the unique chemical stability of the instant scouring compositions and additionally serves to enhance composition performance.

It has been surprisingly discovered that maintenance of the composition pH within the 10.5 to 14 range minimizes the undesirable chemical decomposition of the active chlorine, hypochlorite-yielding bleaching agents, said decomposition generally being encountered when such bleaching agents are admixed with clay in unbuffered aqueous solution. Maintenance of this essential pH range also minimizes the chemical interaction between the strong hypochlorite bleach and the surfactant compounds essentially present in the instant compositions. Finally, high pH values such as those maintained by the instant buffering agent serve to enhance the soil and stain removal properties of the surfactant during utilization of the present compositions.

Any bleach-stable material or mixture of materials which has the effect of altering composition pH to within the 10.5 to 14 range and maintaining it there can be utilized as the buffering agent in the instant invention. Such materials can include, for example, various water-soluble, inorganic salts such as the carbonates, bicarbonates, sequiscarbonates silicates, pyrophosphates, phosphates, tetraborates, and mixtures thereof. Examples of materials which can be used either alone or in combination as the buffering agent herein include sodium carbonate, sodium bicarbonate, sodium sesquicarbonate, sodium silicate, tetrapotassium pyrophosphate, trisodium phosphate, anhydrous sodium tetraborate, sodium tetraborate pentahydrate and sodium tetraborate decahydrate. Preferred buffering agents for use herein include mixtures of tetrapotassium pyrophosphate and trisodium phosphate in a pyrophosphate/phosphate weight ratio of about 2:1 and mixtures of anhydrous sodium carbonate and sodium metasilicate in a carbonate/metasilicate weight ratio of about 3:1.

As will be discussed hereinafter, it is highly preferred to include in the instant compositions a material which acts as a detergent builder, i.e. a material which reduces the free calcium and/or magnesium ion concentration in a surfactant-containing aqueous solution. Some of the above-described materials of the essential buffering agent component additionally serve as builder materials. Such compounds as the carbonates, phosphates and pyrophosphates are of this type. Other buffering agent components such as the silicates and tetraborates perform no building function.

Since presence of a builder in the instant compositions is highly desirable, it is preferred that the essential buffering agent contain at least one compound capable of acting as a builder, i.e. capable of lowering the free calcium and/or magnesium ion content of an aqueous solution containing such ions.

WATER

From about 10% to about 80% by weight, preferably from about 50% to 70% by weight, of the instant composition comprises a water solvent. Water is the medium in which the inorganic, colloid-forming clay and abrasive are suspended to form an abrasive, false body composition. Water also serves to dissolve the soluble components of the instant invention such as the bleach, surfactant, buffering agent and optional materials. Since it is well known that transition metals can react with and deactivate the bleaching agents of the present invention, "water" for purposes of the instant invention means "soft" or deionized water.

OPTIONAL MATERIALS

In addition to the above-described six essential components, the instant scouring compositions can optionally contain other non-essential materials to enhance their performance, stability, or aesthetic appeal. Such materials include optional non-buffering builder compounds, coloring agents and perfumes. Although, as noted above, some of the above described buffering agents do function as builder compounds, it is possible to add other bleach-stable builder compounds which either alone or in combination with other salts do not buffer within the essential 10.5 to 14 pH range required of the buffering agent. Typical of these optional builder compounds which do not necessarily buffer within the essential pH range are certain hexametaphosphates and polyphosphates. Specific examples of such optional buffer materials include sodium tripolyphosphate, potassium tripolyphosphate and potassium hexametaphosphate.

Conventional coloring agents and perfumes can also be added to the instant compositions to enhance their aesthetic appeal and/or consumer acceptability. These materials should, of course, be those dye and perfume varieties which are especially stable against degradation by strong active chlorine bleaching agents.

If present, the above-described optional materials generally comprise no more than about 5% by weight of the total composition.

COMPOSITION PREPARATION

The scouring compositions of the instant invention can be prepared by admixing the above-described essential and optional components together in the appropriate concentrations in any order by any conventional means normally used to form colloidal compositions from clay-water mixtures. Some shear agitation is, of course, necessary to insure preparation of compositions of the requisite false body character. The extent of shear agitation, in fact, can be used to vary as desired the nature of the false-bodied composition so prepared.

In a particularly preferred procedure for preparing the instant compositions, a certain order of addition of components and certain types of shear agitation can be employed to provide compositions have exceptionally desirable abrasive suspension and phase separation properties. In this preferred synthesis procedure, bleaching agent, buffer and water are admixed under moderate shear agitation to provide a uniform solution at the requisite pH. The clay (thickener and suspending agent) is then slowly added to this solution under relatively high shear agitation to form a product having the appropriate false body properties. Abrasive, surfactant, builder, electrolyte and other optionals are then added to the compositions under moderate shear to provide a uniform and homogeneous composition.

The false body scouring cleanser compositions of the instant invention are illustrated by the following examples:

EXAMPLE I

A false body hard surface scouring cleanser of the following composition is prepared.

| COMPONENT | Wt. % |
|---|---|
| Sodium Hypochlorite | 1.1% |
| Gelwhite GP (Sodium montmorillonite clay) | 3.8% |
| Quartz (Particle Size = 50 microns Specific Gravity = 2.65) | 30.0% |
| Hexadecyldimethylammonium Hexanoate | 0.35% |
| Buffering Agent Mixture of Tetrapotassium Pyrophosphate and Trisodium Phosphate in a Pyrophosphate/Phosphate Weight Ratio of 2:1 | 4.5% |
| Deionized Water | Balance |
| Composition pH | 11.8 |

Such a composition is prepared as follows. A 5.25% aqueous solution of sodium hypochlorite (3744 parts); 540 parts of tetrapotassium pyrophosphate; 6000 parts of deionized water; 270 parts of trisodium phosphate and 693 parts of sodium montmorillonite clay are admixed using relatively high shear agitation to the extent necessary to form a false body composition.

A paste containing 5400 parts of quartz, 1148 parts of deionized water and 151 parts of a 30% aqueous solution of hexadecyldimethylammonium hexanoate is prepared by admixing these ingredients.

The abrasive-containing paste is slowly added to the false body composition while the false body composition is liquified under moderate shear agitation.

The resulting scouring composition is false bodied, i.e. gel-like in its quiescent state but easily fluidized by application of shear stress. In its quiescent state, the composition maintains the quartz abrasive in a uniform suspended dispersion. When applied to horizontal or vertical hard surfaces, the composition is not fluid and does not appreciably run along such surfaces.

Such a composition exhibits negligible bleach and/or surfactant decomposition over a storage period of 6 weeks. Such a composition is especially effective for removal of stains and soil from hard surfaces and leaves no noticeable film after the composition has been used and hard surfaces rinsed.

Compositions of substantially similar physical, chemical and performance properties are realized when in the Example I composition, the sodium hypochlorite bleaching agent is replaced with potassium hypochlorite, monobasic calcium hypochlorite, dibasic magnesium hypochlorite, chlorinated trisodium phosphate dodecahydrate, potassium dichloroisocyanurate, sodium dichloroisocyanurate, 1,3-dichloro-5,5-dimethylhydantoin, N-chlorosulfamide, Chloramine T, Dichloramine T, Chloramine B or Dichloramine B in amounts sufficient to provide an equivalent amount of available chlorine.

Compositions of substantially similar chemical, physical and performance properties are realized if in the above-described Example I composition the quartz abrasive material is replaced with an equivalent amount of $TiO_2$ (60 microns, 2.65 specific gravity); pumice (53 microns, 2.2 specic gravity); pumicite (54 microns, 2.9 specific gravity); calcium carbonate (55 microns, 2.8 specific gravity); silica sand (55 microns, 2.4 specific gravity); zirconium silicate (60 microns, 4.6 specific gravity); diatomaceous earth (45 microns, 2.1 specific gravity); whiting (63 microns, 2.7 specific gravity) or feldspar (43 microns, 2.5 specific gravity).

Compositions of substantially similar chemical, physical and performance properties are realized when in the above-described Example I composition the hexadecyldimethylammonium hexanoate surfactant is replaced with substantially equivalent amount of dodecyldimethylammonium acetate, dodecyldimethylammonium hexanoate, or hexadecyldimethylammonium acetate.

EXAMPLE II

A false body hard surface scouring cleanser of the following composition is prepared.

| COMPONENT | Wt. % |
|---|---|
| Sodium Hypochlorite | 1.1% |
| Barasym NAS-100 (Sodium Saponite clay) | 3.0% |
| Silica Sand (Particle Size = 55 microns Specific Gravity = 2.4) | 30.0% |
| Sodium Lauryl Alkyl Sulfate | 0.35% |
| Buffering Agent Mixture of Anhydrous Sodium Carbonate and Sodium Metasilicate in a Carbonate/Metasilicate weight ratio of 3:1 | 4.0% |
| Coloring Agent and Perfume | 0.8% |
| Deionized Water | Balance |
| Composition pH | 11.8 |

Such a composition is prepared in a manner analogous to that employed for the Example I composition. Such a composition is false bodied, i.e., gel-like in its quiescent state but easily fluidized by application of shear stress. In its quiescent state, the composition maintains the silica flour abrasive in a uniform suspended dispersion. When applied to horizontal or vertical hard surfaces, the composition is not fluid and does not appreciably run along such surfaces.

Such a composition exhibits minimal bleach and/or surfactant decomposition over a storage period of ten weeks. Such a composition is especially effective for removal of stains and soil from hard surfaces and leaves no noticeable film after the composition has been used and the hard surfaces rinsed.

Compositions of substantially similar chemical, physical and performance properties are realized when in the above-described Example II composition the sodium hypochlorite bleaching agent is replaced with potassium hypochlorite, monobasic calcium hypochlorite, dibasic magnesium hypochlorite, chlorinated trisodium phosphate dodecahydrate, potassium dichloroisocyanurate, sodium dichloroisocyanurate, 1,3-dichloro-5,5-dimethylhydantoin, N-chlorsulfamide, Chloramine T, Dichloramine T, Chloramine B or Dichloramine B in an amount sufficient to provide an equivalent amount of available chlorine.

Compositions of substantially similar chemical physical and performance properties are realized when in the above-described Example II composition the Barasym NAS-100 sodium saponite clay is replaced with an equivalent amount of fooler clay, Thixogel No. 1, Gelwhite GP, Volclay BC, Volclay No. 325, Black Hills Bentonite BH 450, Veegum Pro or Veegum F, Barasym NAH-100, Barasym SMM-200, Barasym LIH-200, Attagel 50 or a mixture of Barasym NAS-100 smectite and Attagel 50 attapulgite in a smectite/attapulgite weight ratio of about 1:1.

Compositions of substantially similar chemical, physical and performance properties are realized when in the above-described Example II composition the concentration of the silica sand is lowered to about 10% by weight, all other component concentrations except water remaining the same.

Compositions of substantially similar chemical, physical and performance properties are realized when in the above-described Example II composition the sodium lauryl alkyl sulfate is replaced with an equivalent amount of sodium coconut alkyl sulfate, potassium coconut alkyl sulfate, or potassium lauryl alkyl sulfate.

Compositions of substantially similar chemical, physical and performance properties are realized when in the above-described Example II composition the carbonate/metasilicate buffering agent is replaced with an equivalent amount of a mixture of tetrapotassium pyrophosphate and trisodium phosphate in a pyrophosphate/phosphate weight ratio of about 2:1 (pH = 11.8); sodium carbonate (pH = 11.3); sodium metasilicate (pH = 12.8); trisodium phosphate (pH = 12.3) or a mixture tetrapotassium pyrophosphate and sodium carbonate in a pyrophosphate/carbonate weight ratio of 1.5:1 (pH = 11.0).

Compositions of substantially similar chemical, physical and performance properties are realized when the above-described Example II composition additionally contains about 1% by weight of sodium tripolyphosphate, potassium tripolyphosphate, or potassium hexametaphosphate as a builder.

SOIL REMOVAL PERFORMANCE

The ability of the instant false body scouring compositions to remove soil from hard surfaces is determined by a test involving removal of various types of soil from commercially available linoleum and vinyl asbestos tiles. Soil types employed include kitchen-type soil and waxy soil.

Kitchen soils are mainly fatty with some particulate content and are prepared by mixing particulate soil (humus, cement, sand, clay, rust and soot) with a high level of polyunsaturated vegetable oil. Waxy soil consists of particulate soil embedded in a floor wax film and soil-covered agglomerate of floor wax.

Rectangular pieces (4 inches × 3 inches) of test tiles are soiled as follows: Some tiles are sprayed with the kitchen soil mixture and aged for two weeks to polymerize the cooking oil. Other tiles have waxy soil spread onto them with a paint roller and are then aged for 1 day.

Test tiles are washed using two solutions of product to be tested. Washing is accomplished by utilizing a Gardner Model M-105-A Washability Machine, a device for mechanically passing a sponge across a flat surface in a uniform and reproducible manner.

Test solutions employed are prepared by mixing (1) two ounces of the composition described in Example II; and (2) two ounces of Comet, a commercial hypochlorite-containing scouring cleanser; with one gallon of water (115° F 7 grains hardness).

The same number of strokes with each test solution is utilized. After cleansing the test tiles are allowed to dry and are visually graded by a panel of three human graders. Grading results indicate that the solution of the Example II composition compares favorably with the solution of the commercial cleanser, Comet, in its ability to remove waxy and kitchen soil from linoleum and vinyl asbestos tile.

FILMING AND STREAKING EVALUATION

Th tendency of the instant composition to leave a noticeable haze or film after use is determined by means of a filming and streaking evaluation. The test is carried out by scrubbing a 4 inch × 2 inch polished black ceramic bathroom tile with the Example II composition. One gram of the Example II composition is placed on the tile. A folded wet terry cloth swatch is used to rub the composition on the tile for 20 seconds. The tile is then rinsed with one pass of a squeeze bottle containing distilled water, set upright and allowed to air dry. The test tile is then visually graded for opaqueness, i.e. its ability to reflect light. A smaller amount of light reflected indicates that the test tile has become yellower and more opaque. Tiles tested with the Example II composition exhibit minimal reduction of reflected light, i.e. minimal hazing, filming and streaking.

PHYSICAL STABILITY EVALUATION

Compositions of the instant invention are graded for their ability not to separate into distinct physical phases upon storage for an extended period of time. The Example II composition is allowed to stand for periods of up to one month and is periodically checked to determine the height of any clear liquid phase which separates at the top of the test vessel. Samples tested at 30° F, 40° F, ambient temperatures, 80° F and 100° F exhibit minimal and commercially acceptable phase separation after one month. Furthermore, the false body structure after one month still suspends abrasive material uniformly throughout with no settling or deposition of abrasive on the bottom of the vessel.

CHEMICAL STABILITY EVALUATION

The ability of the instant compositions to remain chemically active after extended periods of storage is determined by a chemical stability evaluation. Compositions of the instant invention as well as modifications of such compositions are monitored for a period of one month while periodic samples are tested for composition pH and available chlorine content. Loss in available chlorine is taken as an indication that the hypochlorite-yielding bleaching agent is decomposing or reacting with other composition components.

Available chlorine and pH measurements of the Example II composition are taken at ambient temperature over a period of one month. Composition pH drops no more than 0.8 pH unit indicating the effectiveness of the buffering agent mixture in maintaining pH within the essential 10.5–14 range as well as minimal interaction between buffering agent and other composition materials. Available chlorine content of the composition drops to a minimal and insignificant extent (i.e. no more than the available chlorine loss of a conventional 5% aqueous hypochlorite solution), also indicating minimal chemical interaction between the bleaching agent and other composition components.

Available chlorine and pH measurements are taken over a one month period at ambient temperature of a composition similar to the Example II composition, said similar composition, however, containing no buffering agent. Initial composition pH of 11.8 is realized by the addition of NaOH. Measurements show that the composition pH drops from 11.8 to near neutral over the 1 month period indicating that chemical interaction of the composition components will cause such a pH drop if the essential buffering agent is not present in the instant compositions. Available chlorine measurements indicate an essentially complete loss of available chlorine after a one month period, thereby further demonstrating that unacceptable chemical interaction of components occurs if composition pH is not maintained within the essential 10.5–14 range by means of a buffering agent.

Available chlorine and pH measurements are taken over a one-month period at ambient temperature of a composition similar to the Example II composition, said similar composition, however, having the sodium lauryl alkyl sulfate surfactant replaced with an equivalent amount of the conventional surfactant, sodium $C_{12}$ linear alkyl benzene sulfonate. Measurements of pH show that the buffering agent does maintain composition pH within the essential 10.5–14 range. Available chlorine measurements, however, show a significant and unacceptable drop in composition available chlorine content over the 1 month period. Thus, even though pH is maintained within the essential limitations, presence of a surfactant other than the essential surfactant materials specified results in undesirable chemical interaction between bleaching agent and surfactant.

What is claimed is:

1. An aqueous false body fluid hard-surface scouring cleanser comprising

A. from about 0.2% to 5% by weight of a bleaching agent which yields a hypochlorite species in aqueous solution;

B. from about 1% to 6% by weight of an inorganic colloid-forming clay selected from the group consisting of smectites, attapulgites and mixtures of smectite and attapulgites;

C. from about 0.1% to 3% by weight of a bleach-stable surfactant selected from the group consisting of water-soluble alkyl sulfates containing from about 8 to about 18 carbon atoms in the alkyl group;

D. from about 5% to 60% by weight of insoluble particulate abrasive material having particle diameters ranging from one micron to about 250 microns and a specific gravity of from about 0.5 to about 5.0;

E. from about 1% to 15% by weight of an inorganic buffering agent capable of maintaining composition pH within the range of from about 10.5 to 14; and F. from about 10% to 80% by weight of deionized water.

2. A composition in accordance with claim 1 wherein

A. the bleaching agent comprises from about 0.5% to 2.0% by weight of the composition;

B. the inorganic, colloid-forming clay comprises from about 1.5% to 4.0% by weight of the composition;

C. the bleach-stable surfactant comprises from about 0.25% to 1% by weight of the composition;

D. the insoluble particulate abrasive material comprises from about 8% to 32% by weight of the composition;

E. the inorganic buffering agent comprises from about 2% to 5% by weight of the composition; and F. water comprises from about 50% to 70% by weight of the composition.

3. A composition in accordance with claim 2 wherein

A. the bleaching agent is selected from the group consisting of alkali metal hypochlorites, alkaline earth metal hypochlorites, hypochlorite addition products, chloramines, chlorimines, chloramides, and chlorimides;

B. the inorganic colloid-forming clay is selected from the group consisting of smectites and mixtures of smectites and attapulgites in smectite/attapulgite weight ratios of from about 5:1 to 1:5;

C. the bleach stable surfactant is a water-soluble alkyl sulfate containing from about 8 to 18 carbon atoms in the alkyl group;

D. the insoluble particulate abrasive material has particle diameters ranging from 2 to 60 microns and a specific gravity of from 1.0 to 2.8; and E. the buffering agent is a water-soluble inorganic salt selected from the group consisting of carbonates, bicarbonates, sesquicarbonates, silicates, pyrophosphates, phosphates, tetraborates, and mixtures thereof, and is sufficient to provide a composition pH within the range from about 11 to 13.

4. A composition in accordance with claim 3 wherein the bleaching agent is selected from the group consisting of sodium hypochlorite, potassium hypochlorite, monobasic calcium hypochlorite, dibasic magnesium hypochlorite, chlorinated trisodium phosphate dodecahydrate, potassium dichloroisocyanurate, sodium dichloroisocyanurate, 1,3-dichloro-5,5-dimethylhydantoin, N-chlorosulfamide, Chloramine T, Dichloramine T, Chloramine B and Dichloramine B.

5. A composition in accordance with claim 3 wherein the colloid-forming clay is a smectite clay selected from the group consisting of montmorillonites, volchonskoites, nontronites, beidellites, hectorites, saponites, sauconites and vermiculites.

6. A composition in accordance with claim 3 wherein the concentration of the insoluble particulate abrasive material is greater than about 20% by weight and wherein the colloid-forming clay is a mixture of smectite and attapulgite in a smectite/attapulgite weight ratio of from about 2:1 to 1:2; the smectite being selected from the group consisting of montmorillonites, volchonskoites, nontronites, beidellites, hectorites, saponites, sauconites and vermiculites.

7. A composition in accordance with claim 3 wherein the alkyl sulfate surfactant is selected from the group consisting of sodium lauryl alkyl sulfate, sodium stearyl alkyl sulfate, sodium palmityl alkyl sulfate, sodium decyl sulfate, sodium myristyl alkyl sulfate, potassium lauryl alkyl sulfate, potassium stearyl alkyl sulfate, potassium decyl sulfate, potassium palmityl alkyl sulfate, potassium myristyl alkyl sulfate, sodium dodecyl sulfate, potassium dodecyl sulfate, potassium tallow alkyl sulfate, sodium tallow alkyl sulfate, sodium coconut alkyl sulfate, potassium coconut alkyl and mixtures thereof.

8. A composition in accordance with claim 3 wherein the insoluble abrasive particulate material is selected from the group consisting quartz, pumice, pumicite, titanium dioxide, silica sand, calcium carbonate, zirconium silicate, diatomaceous earth, whiting and feldspar.

9. A composition in accordance with claim 3 wherein the buffering agent is selected from the group consisting of sodium carbonate, sodium metasilicate, trisodium phosphate, a mixture of tetrapotassium pyrophosphate and trisodium phosphate in a pyrophosphate/phosphate weight ratio of about 2:1, a mixture of anhydrous sodium carbonate and sodium metasilicate in a carbonate/metasilicate weight ratio of 3:1 and a mixture of tetrapotassium pyrophosphate and anhydrous sodium carbonate in a pyrophosphate/carbonate weight ratio of 1.5:1.

10. A composition in accordance with claim 3 wherein

A. the bleaching agent is selected from the group consisting of sodium hypochlorite, potassium hypochlorite, monobasic calcium hypochlorite, dibasic magnesium hypochlorite, chlorinated trisodium phosphate dodecahydrate, potassium dichloroisocyanurate, sodium dichloroisocyanurate, 1,3-dichloro- 5,5-dimethylhydantoin, N-chlorosulfamide, Chloramine T, Dichloramine T, Chloramine B and Dichloramine B;

B. the smectite clay used alone or in admixture with attapulgite is selected from the group consisting of montmorillonites, volchonskoites, nontronites, beidellites, hectorites, saponites, sauconites and vermiculites;

C. the alkyl sulfate surfactant is selected from the group consisting of sodium lauryl alkyl sulfate, sodium stearyl alkyl sulfate, sodium palmityl alkyl sulfate, sodium decyl sulfate, sodium myristyl alkyl sulfate, potassium lauryl alkyl sulfate, potassium stearyl alkyl sulfate, potassium decyl sulfate, potassium palmityl alkyl sulfate, potassium myristyl alkyl sulfate, sodium dodecyl sulfate, potassium dodecyl sulfate, potassium tallow alkyl sulfate, sodium tallow alkyl sulfate, sodium coconut alkyl sulfate, potassium coconut alkyl sulfate, and mixtures thereof;

D. the insoluble particulate abrasive material is selected from the group consisting of quartz, pumice, pumicite, titanium dioxide, silica sand, calcium carbonate, zirconium silicate, diamatomaceous earth, whiting and feldspar; and E. the buffering agent is selected from the group consisting of sodium carbonate, sodium metasilicate, trisodium phosphate, a mixture of tetrapotassium pyrophosphate and trisodium phosphate in a pyrophosphate/phosphate weight ratio of 2:1, a mixture of anhydrous sodium carbonate and sodium metasilicate in a carbonate/metasilicate weight ratio of about 3:1 and a mixture of tetrapotassium pyrophosphate and anhydrous sodium carbonate in a pyrophosphate/carbonate weight ratio of about 1.5:1.

11. A composition in accordance with claim 10 wherein the bleaching agent is sodium hypochlorite.

12. A composition in accordance with claim 10 wherein the smectite clay is selected from the group consisting of montmorillonites, hectorites and saponites.

13. A composition in accordance with claim 10 wherein the alkyl sulfate surfactant is selected from the group consisting of sodium coconut alkyl sulfate, potassium coconut alkyl sulfate, potassium lauryl alkyl sulfate and sodium lauryl sulfate.

14. A composition in accordance with claim 10 wherein the buffering agent contains at least one compound which acts as a builder material capable of reducing the free calcium and/or magnesium ion content of an aqueous solution.

15. A composition in accordance with claim 10 wherein

A. the bleaching agent is sodium hypochlorite;

B. the smectite clay is selected from the group consisting of Gelwhite GP, Barasym NAS-100 and Barasym NAH-100;

C. wherein the alkyl sulfate surfactant is selected from the group consisting of sodium coconut alkyl sulfate, potassium coconut alkyl sulfate, potassium lauryl alkyl sulfate and sodium lauryl alkyl sulfate;

D. the insoluble abrasive particulate material is silica sand; and

E. the buffering agent is selected from the group consisting of a mixture of tetrapotassium pyrophosphate and trisodium phosphate in a pyrophosphate/phosphate weight ratio of about 2:1 and a mixture of anhydrous sodium carbonate and sodium metasilicate in a carbonate/metasilicate weight ratio of about 3:1.

16. A composition in accordance with claim 15 wherein the concentration of the insoluble particulate abrasive material is greater than about 20% by weight and therein the colloid-forming clay is a mixture of smectite and attapulgite in a smectite/attapulgite weight ratio of about 1:1; the smectite being selected from the group consisting of Gelwhite GP, Barasym NAS-100 and Barasym NAH-100; and the attapulgite being selected from the group consisting of Attagel 40, Attagel 50 and Attagel 150.

17. A composition in accordance with claim 2 which additionally contains up to 5% by weight of a bleach-stable builder compound selected from the group consisting of hexametaphosphates, and polyphosphates.

* * * * *